US012521593B2

(12) United States Patent
Miklos

(10) Patent No.: US 12,521,593 B2
(45) Date of Patent: Jan. 13, 2026

(54) DISC BRAKE STRUCTURE FOR MACHINES, PRIMARILY FOR STRENGTH TRAINING MACHINES

(71) Applicant: B3 Trainer Kft., Balatonvilágos (HU)

(72) Inventor: Akos Miklos, Malomházi (HU)

(73) Assignee: B3 Trainer Kft., Balatonvilágos (HU)

( * ) Notice: Subject to any disclaimer, the term of this patent is extended or adjusted under 35 U.S.C. 154(b) by 127 days.

(21) Appl. No.: 18/655,348

(22) Filed: May 6, 2024

(65) Prior Publication Data

US 2025/0339724 A1 Nov. 6, 2025

(51) Int. Cl.
*A63B 21/015* (2006.01)

(52) U.S. Cl.
CPC ..... *A63B 21/015* (2013.01)

(58) Field of Classification Search
CPC ..... A63B 21/015; A63B 7/045
See application file for complete search history.

(56) References Cited

U.S. PATENT DOCUMENTS 3,599,974 A * 8/1971 Price ..... A63B 21/015 482/118
5,496,236 A * 3/1996 Buonauito ..... A63B 21/1609 482/110
6,443,874 B1 * 9/2002 Bennett ..... A63B 23/03508 128/845
2024/0108943 A1 * 4/2024 Barbour ..... A63B 21/0618

FOREIGN PATENT DOCUMENTS

HU 5403 U 3/2022
WO 03081085 A2 10/2003

OTHER PUBLICATIONS

Wojciech Sawczuk, et al., Evaluation of Wear of Disc Brake Friction Linings and the Variability of the Friction Coefficient on the Basis of Vibroacoustic Signals, Sensors, 2021, pp. 1-21, vol. 21 No. 17.

* cited by examiner

*Primary Examiner* — Andrew M Kobylarz
(74) *Attorney, Agent, or Firm* — Bayramoglu Law Offices LLC

(57) ABSTRACT

A disc brake structure for machines, primarily for strength training machines, comprises a brake disc, the frame of the machine, and at least one pull spring or pressure spring, the spring is connected to two brake pads, a brake pad retaining bracket is connected to the brake pad, and the brake disc has a brake disc axis. One end of the brake pad retaining bracket is fixed to the frame with a back-and-forth movable connecting device, the other end of the brake pad retaining bracket is fixed to the brake pad with a hinged connector element, and the brake pad retaining bracket is obliquely connected to the brake pad in the direction of rotation of the brake disc.

15 Claims, 9 Drawing Sheets

DISC BRAKE STRUCTURE FOR MACHINES, PRIMARILY FOR STRENGTH TRAINING MACHINES

TECHNICAL FIELD

The present invention relates to the technical field of strength training machines, and in particular to a disc brake structure for strength training machines.

BACKGROUND

In a group of strength training machines, it is known that force exertion occurs against an adjustable braking system. While such devices are smaller than weight-lifting machines, their task is to make the user exert consistent force from the beginning to the end of the exercise. The significant material savings provided by muscle-building machines equipped with a braking system also have significant environmental and economic benefits. Their smaller size also increases versatility; therefore, the advancement of such devices is expected. For example, utility model description No HU5403U describes such a solution.

Document No WO 03081085 A2 describes a device for damping jerky sliding, where the friction mass is pressed against the moving surface by an external load force or a secondary vibration system. Furthermore, the rod supporting the secondary vibration system is aligned with the direction of movement of the brake disc, which, however, is not fixed to the rod by a back-and-forth pivot, but is welded onto it. The mass fits the surface with its entire surface, but it cannot rotate. Moreover, the solution includes only one friction mass loaded with a pull spring, which is not supplemented with a rocker.

The article of Sawczuk, W. et al "Evaluation of Wear of Disc Brake Friction Linings and the Variability of the Friction Coefficient on the Basis of Vibroacoustic Signals" from MDPI, Sep. 3, 2021, presents the results of friction and vibroacoustic tests conducted on a railway disc brake caliper, where we can see a rotating disc supported by a spring and a damping, and a brake pad supported by it in a pivoting manner. The brake pad is pressed against the disc by a pressure spring, and parallel to the spring, an additional damping is applied. However, the brake pad only contacts the brake disc along a line, not with its entire surface. The solution includes only one brake pad, which is pressed against the brake disc solely by one pressure spring. Furthermore, the device is not supplemented with a rocker, which would connect the spring to the brake pads were a pull spring applied. Another disadvantage is that the brake pad contacts the opposite-speed part of the disc, resulting in the occurrence of the stick-slip phenomenon in this area.

Previous solutions applied for strength training used disc brakes commonly found in bicycles and cars. Their disadvantage was that the brake discs often stuttered or the brake pads were pressed against the disc, resulting in the so-called stick-slip phenomenon, requiring greater force during startup.

SUMMARY

The purpose of the invention is to eliminate the shortcomings of previous solutions.

We have recognized that the severity of jerky sliding can be controlled by reducing the adhesive friction force occurring just before slipping. However, this requires reducing the perpendicular contact force on the surface and softening the normal dynamics. One possible way to achieve this is to place brake pads on arms capable of rotating, allowing the force required for braking to be introduced into the system parallel to the contact surface. If this is done through an elastic element, allowing minimal rotation of the brake arms, the designed brake system can provide much smoother braking force and dynamic behaviour compared to classic mechanical brakes. The reason for this is that when adherence occurs, the brake arm can move together with the object to be braked over a short distance. Thus, on the one hand, the braked object can continue to move even in the adhered state, so it never comes to a complete stop, and, on the other hand, the increase in normal contact force and relative speed will be smaller at the moment of separation due to the rotation of the arm. Additionally, after slipping, the elastic element, with the potential energy it accumulated, pulls back the brake lever with a force greater than the constant prescribed braking force, causing an increase in the normal force and thus the sliding friction force.

In our invention, the friction between the brake pads and the brake disc maintains the braking force, as in a traditional disc brake, but the brake pads are not fixed to fixed points. The brake pads are held on each side by a rod, which is fixed to an axis with a back-and-forth pivot. The brake pads are attached to the other end of the rods so that they can rotate and always make contact on their entire surface with the brake disc. The brake pads are pressed against the brake disc by a spring. Depending on the placement of the spring, it can be a pull spring or a pressure spring. If only one spring is installed, the structure is supplemented with a rocker, which connects the spring to the two brake pads.

The inventive idea includes that the rods holding the brake pads should be oriented towards the direction of rotation of the brake disc, and they should form an angle (preferably 15 to 25 degrees) with the frame.

Disc brake structure according to the invention for machines, primarily for strength training machines, which includes a brake disc, the frame of the machine, and at least one pull or pressure spring, the spring is connected to two brake pads, a brake pad retaining bracket is connected to the brake pad, and the brake disc has a brake disc axis. A distinctive feature of the invention is that one end of the brake pad retaining bracket is fixed to the frame with a back-and-forth movable connecting device, the other end of the brake pad retaining bracket is fixed to the brake pad with a hinged connector element, and the brake pad retaining bracket is obliquely connected to the brake pad in the direction of rotation of the brake disc.

In one possible embodiment, the longitudinal axis of the brake pad retaining bracket forms an angle of 15 to 25 degrees with the straight line perpendicular to the frame wall. When one spring is applied, the brake pads are connected to the spring via a fork-shaped rocker. The springs are secured to the machine via a spring adjustment device.

BRIEF DESCRIPTION OF THE DRAWINGS

The invention is presented in in the figures.

DETAILED DESCRIPTION OF THE EMBODIMENTS

Figure 1:
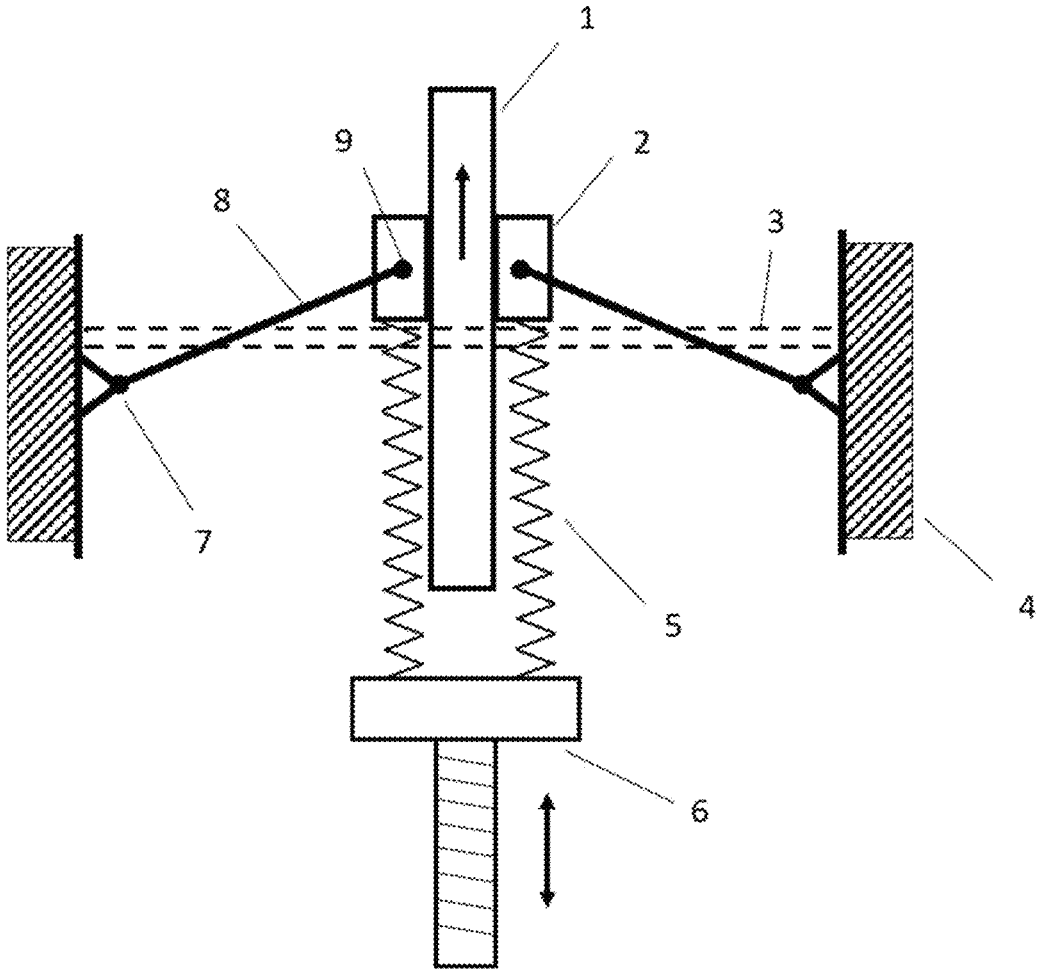
FIG. 1 shows the structure with two pull springs from above.

FIG. 1 shows the rotating brake disc 1, the brake pads 2, a fragment of the frame 4 of the strength training machine, the pull springs 5*a*, the spring adjustment device 6, and the brake pad retaining bracket 8. The brake disc axis 3 is marked with a double broken line. The rotating, and back-and-forth moving connecting device 7 is located between the brake pad retaining bracket 8 and the frame 4. The turning and hinged connector element 9 is located between the rod-shaped brake pad retaining bracket 8 and the brake pad 2. The angle between the brake pad retaining bracket 8 and the straight line 4*a* perpendicular to the frame 4 wall, which is 20 degrees in this example, is marked with an a. The direction of rotation of the brake disc 1 is marked with an arrow. The direction of movement of the spring adjustment device 6 is marked with a double arrow. Commonly, the spring adjustment device 6 is a regulating screw that is mounted onto the strength training machine. Each pull spring 5*a* is connected to a brake pad 2. Each brake pad 2 is located on a different side of the brake disc 1.

Figure 2:
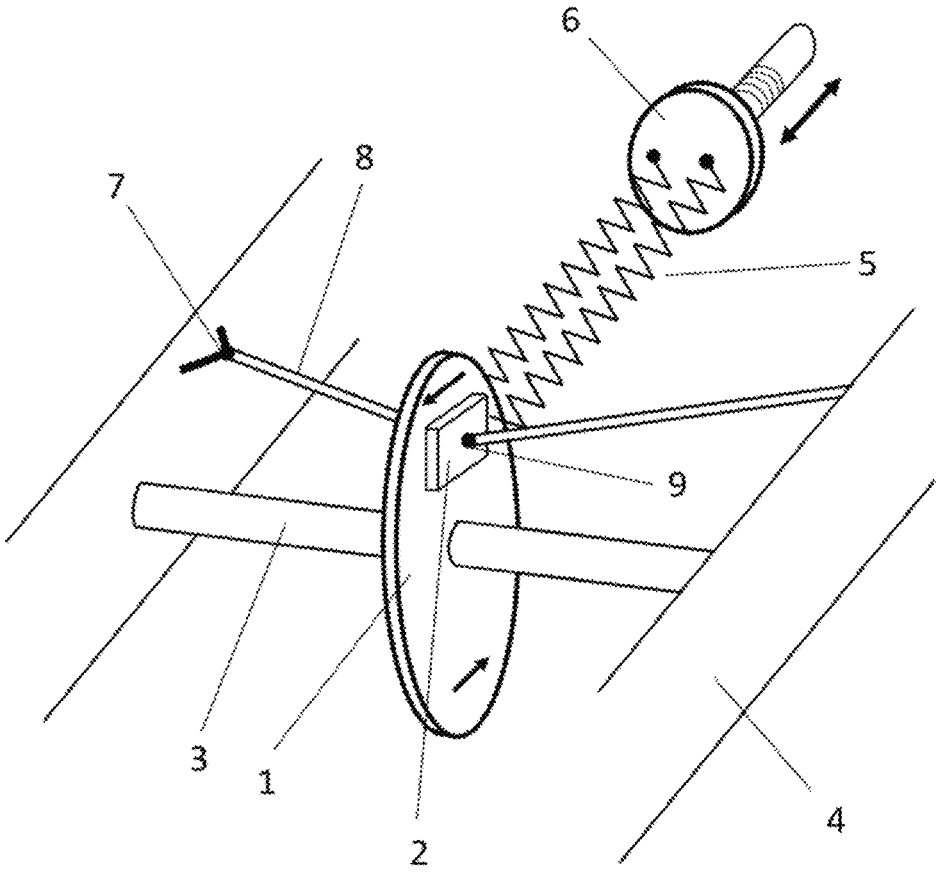
FIG. 2 shows the structure with two pull springs spatially.

FIG. 2 also shows the structure with two pull springs 5*a*, and it also shows the brake disc 1, the brake pad 2, the brake disc axis 3, the frame 4, the spring adjustment device 6, the connecting device 7, the brake pad retaining bracket 8, and the connector element 9.

Figure 3:
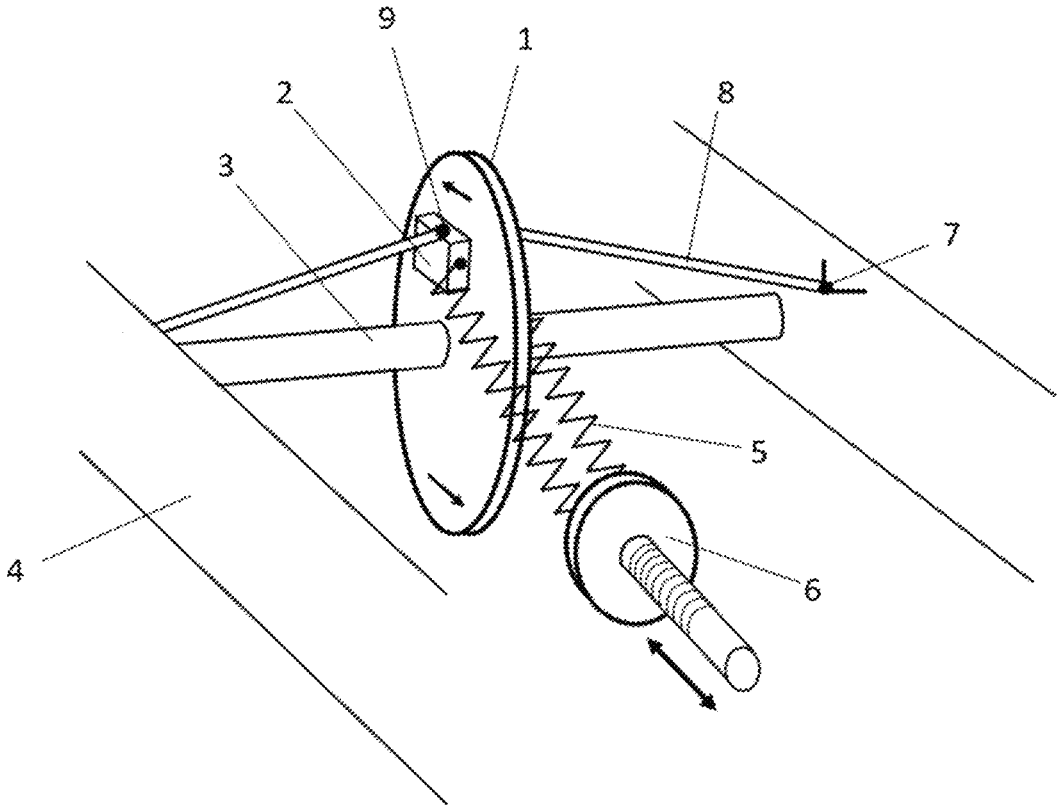
FIG. 3 shows the structure according to FIG. 2 from the side.

FIG. 3 also shows the structure with two pull springs 5*a*, and it also shows the brake disc 1, the brake pad 2, the brake disc axis 3, the frame 4, the spring adjustment device 6, the connecting device 7, the brake pad retaining bracket 8, and the connector element 9.

Figure 4:
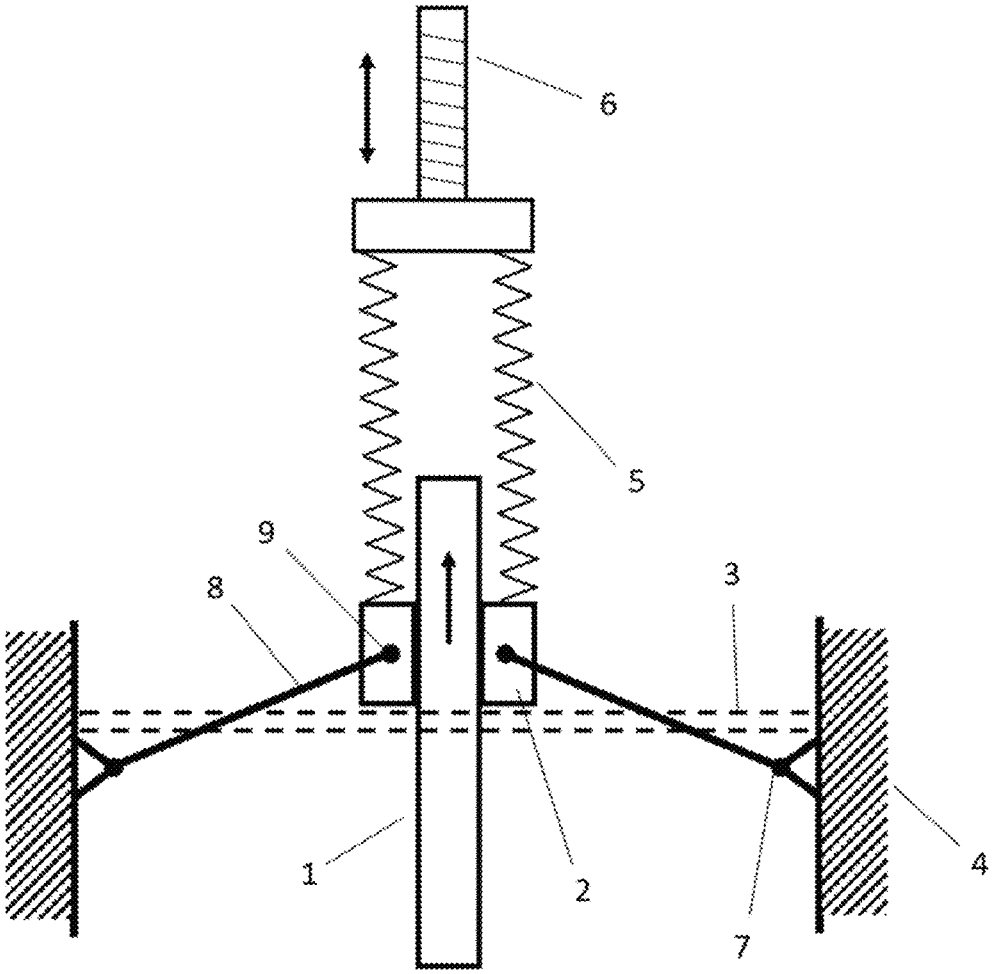
FIG. 4 shows the structure with two pressure springs from above.

FIG. 4 shows the structure with two pressure springs 5*b*, and it also shows the rotating brake disc 1, the brake pads 2, the brake disc axis 3 marked with a broken line, a segment of the frame 4 of the strength training machine, the spring adjustment device 6, the rotating connecting device 7, the brake pad retaining bracket 8, and the rotating connector element 9.

Figure 5:
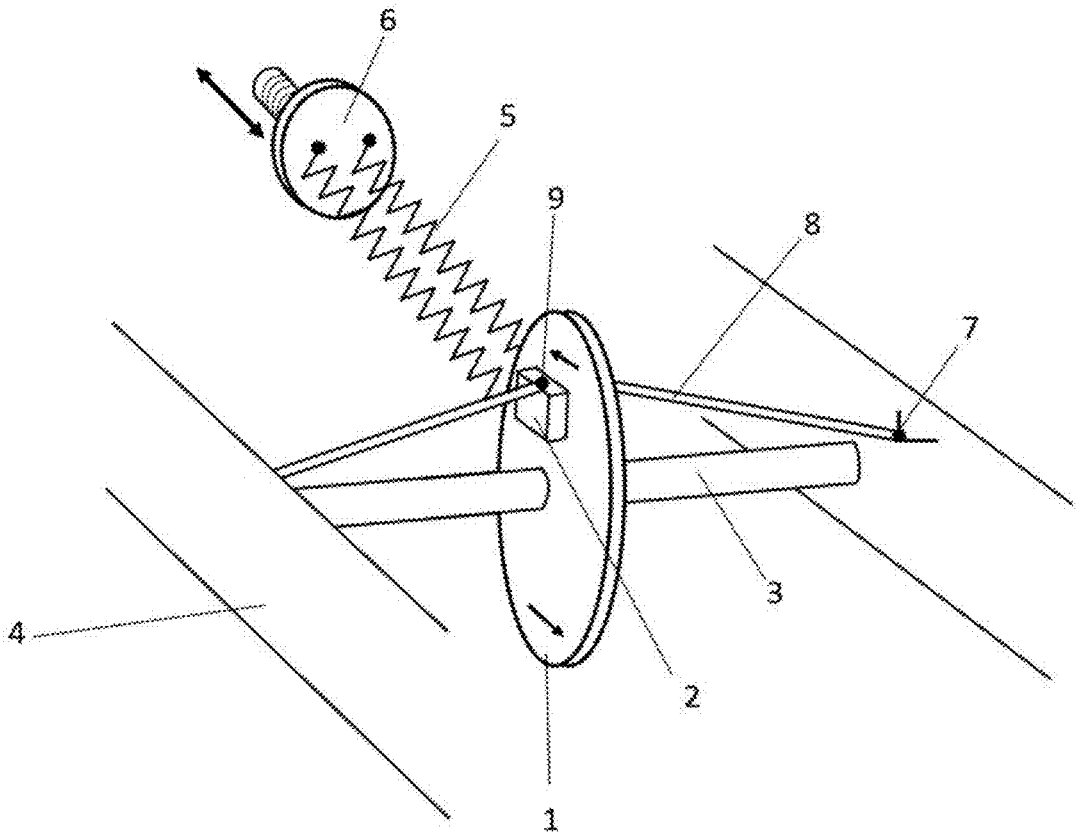
FIG. 5 shows the structure with two pressure springs spatially.

FIG. 5 shows the structure with two pressure springs 5*b*, and it also shows the brake disc 1, the brake pad 2, the suitably rotating brake disc axis 3, the frame 4, the spring adjustment device 6, the rotating connecting device 7, the brake pad retaining bracket 8, and the rotating connector element 9.

Figure 6:
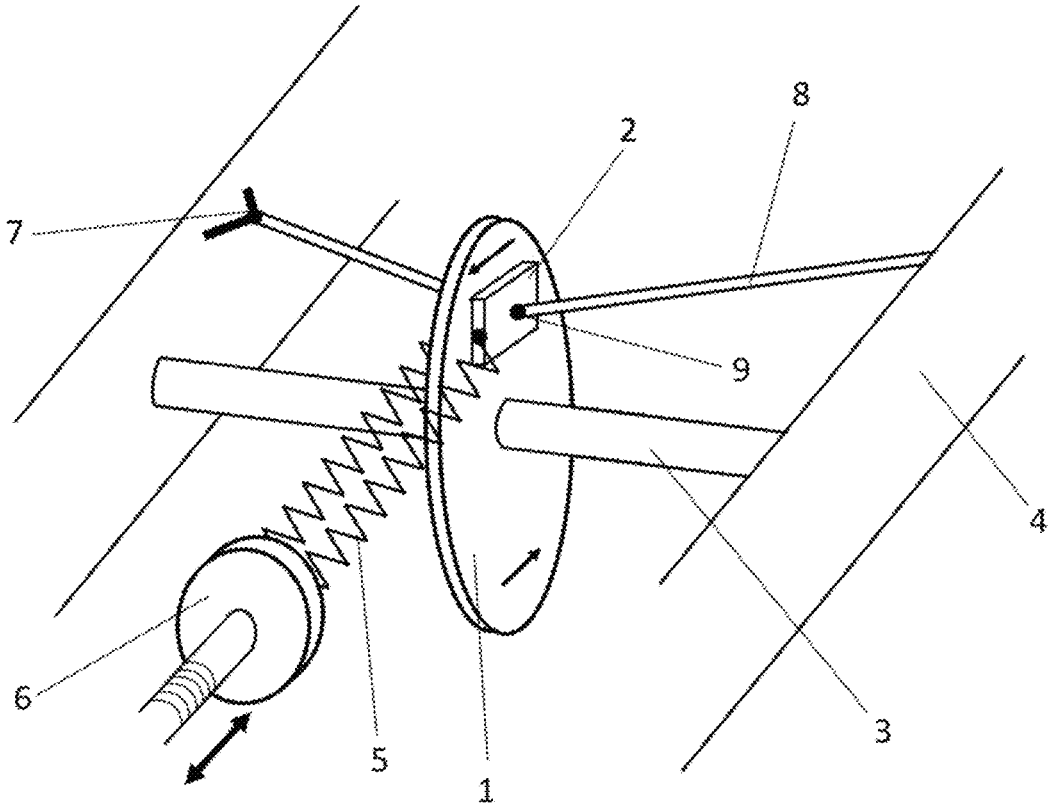
FIG. 6 shows the structure according to FIG. 5 from the side.

FIG. 6 also shows the structure with two pressure springs 5*b*, and it also shows the brake disc 1, the brake pad 2, the brake disc axis 3, the frame 4, the spring adjustment device 6, the connecting device 7, the brake pad retaining bracket 8, and the connector element 9.

Figure 7:
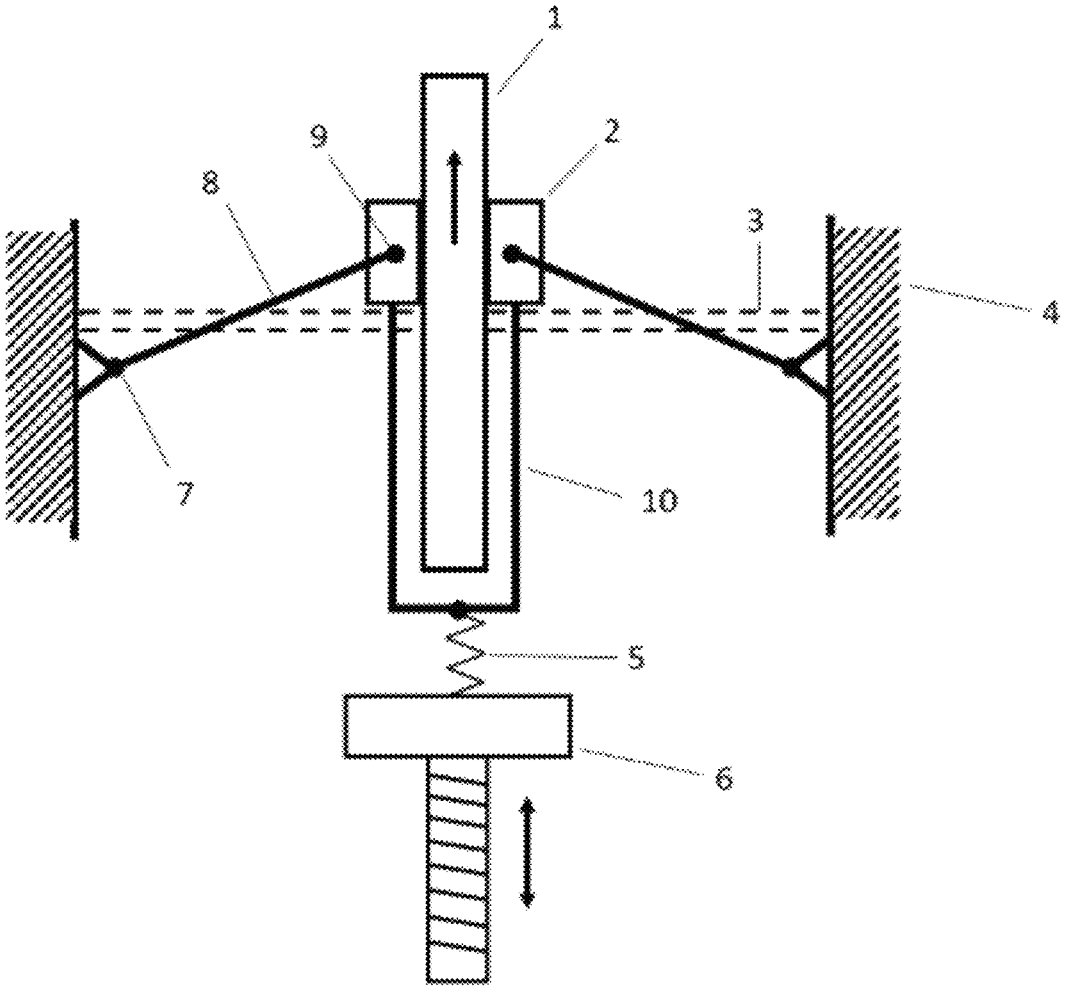
FIG. 7 shows the structure with one pull spring from above.

FIG. 7 shows the structure with one pull spring 5*a*, and it also shows the brake disc 1, the brake pad 2, the brake disc axis 3, the frame 4, the spring adjustment device 6, the connecting device 7, the brake pad retaining bracket 8, and the connector element 9. The pull spring 5*a* is connected to the brake pads 2 through a rocker 10 (swinging lever). Practically, the fork-shaped swinging rocker 10 serves as replacement for one spring 5*a*, 5*b* by keeping the brake discs 2 in balance.

Figure 8:
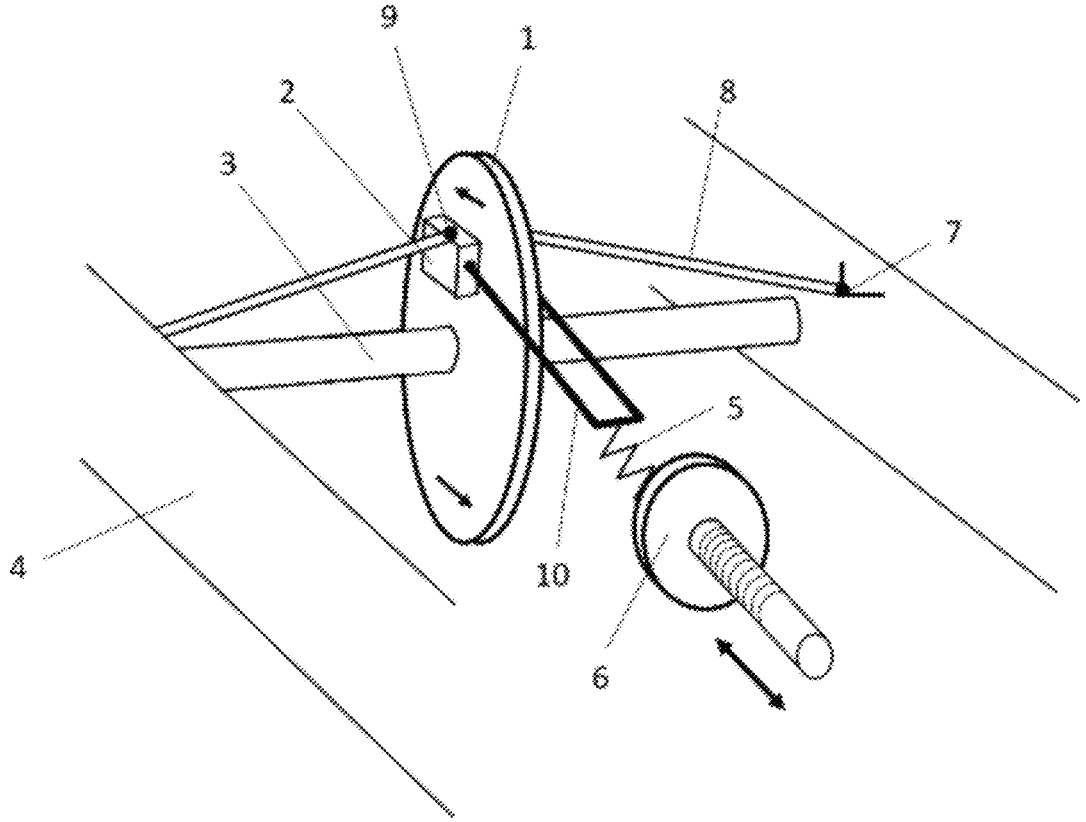
FIG. 8 shows the structure with one pull spring spatially.

FIG. 8 shows the structure with one pull spring 5*a* according to FIG. 7 from a different perspective. It also shows the brake disc 1, the brake pad 2, the brake disc axis 3, the frame 4, the spring adjustment device 6, the connecting device 7, the brake pad retaining bracket 8, and the connector element 9. The pull spring 5*a* is connected to the brake pads 2 through a rocker 10.

Figure 9:
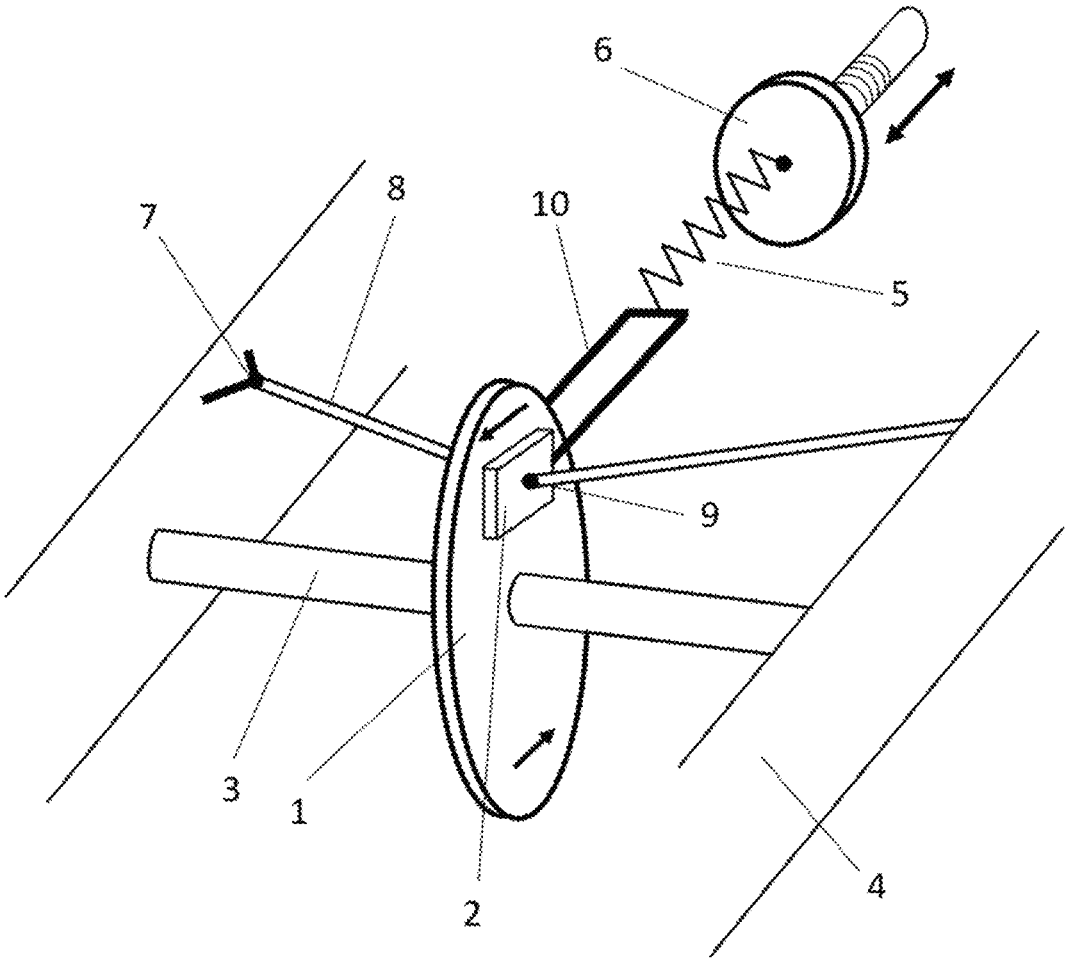
FIG. 9 shows the structure with one pressure spring spatially.

FIG. 9 shows the structure with one pressure spring 5*b*, and it also shows the brake disc 1, the brake pad 2, the brake disc axis 3, the frame 4, the spring adjustment device 6, the connecting device 7, the brake pad retaining bracket 8, and the connector element 9. The pull spring 5*a* is connected to the brake pads 2 through a rocker 10.

Practically, the pull spring 5*a* and the pressure spring 5*b* are equal and serve the same purpose, and they both exert spring force into the same direction. The springs 5*a*, 5*b* press the brake pads 2 against the brake disc 1. The ball bearing of the brake disc axis 3, not shown, is located by the frame 4. Using the strength training machine, the brake disc 1 is also driven through the brake disc axis 3, not shown.

In contrast to known disc brakes, the brake pads 2 are not fixed to fix points. The brake pads 2 are held on both sides by a brake pad retaining bracket 8, which is suitably fixed onto the frame 4 through a back-and-forth moving connecting device 7. The brake pads 2 are fixed onto the other end of the brake pad retaining bracket 8 through a hinged connector element 9 so that they can turn and always connect to the brake disc 1 on their entire surface. Suitably, the brake pads 2 are pressed against the brake disc 1 by one or two springs 5*a*, 5*b*. If only one spring 5*a*, 5*b* is installed, the structure is supplemented with a fork-shaped swinging rocker 10, which connects the spring 5*a*, 5*b* to the two brake pads 2.

The rod-shaped brake pad retaining brackets 8 tilt in the direction of rotation of the brake disc 1, and their axis forms an angle of preferably 15 to 25 degrees with the plane of the frame 4.

The invention has numerous advantages. It is known that the coefficient of sliding friction is smaller than the coefficient of static friction, so a stick-slip effect occurs and the relative speed suddenly jumps in traditional brakes. As a result of these jumps, periodic, quasi-periodic, or even chaotic jerky movements can easily occur during uniform sliding movements, especially at low relative speeds, where one of the contacting bodies can adhere due to minor disturbances. The repeated sequences of adhesion and slipping thus formed are commonly referred to as stick-slip. The stick-slip effect is undesirable because it is accompanied by significant noise and vibrations, and it reduces the lifespan of the contacting surfaces. In strength training machines equipped with a braking system, it is particularly disadvantageous because, in addition to stick-slip movement, greater effort is required to start the rotational movement of the brake disc than to maintain it, so the muscle training machine cannot replace weight machines exerting uniform resistance throughout due to gravity. The brake pads of the disc brake according to our invention, fitted with a hinged connector element, always make contact with the brake disc on their entire surface.

The hinge compensates for geometric deviations and reduces and prevents the stick-slip effect. Finally, another advantage is that, in our invention, the brake force can be easily adjusted by preloading the spring.

The muscle training fitness machine can be a bicycle, rowing machine, or any strength training machine that converts force exertion into rotational motion. However, the invention is not limited to fitness machines; the brake system can also be used in other industries, such as the automotive industry, where uniform braking and avoiding the stick-slip effect are required.

The invention claimed is:

1. A disc brake structure for machines, primarily for strength training machines, comprising:

a brake disc;

a frame;

at least one pull spring or pressure spring connected to two brake pads; and a respective brake pad retaining bracket is connected to each respective brake pad of the two brake pads;

wherein the brake disc has a brake disc axis;

one end of the brake pad retaining bracket is fixed to the frame with a back-and-forth movable connecting device, the other end of the brake pad retaining bracket is fixed to the respective brake pad of the two brake pads with a hinged connector element; and the brake pad retaining bracket is obliquely connected to the respective brake pad of the two brake pads in a direction of rotation of the brake disc.

2. The disc brake structure according to claim 1, wherein a longitudinal axis of the brake pad retaining bracket forms an angle of 15 to 25 degrees with a straight line perpendicular to a frame wall.

3. The disc brake structure according to claim 2, wherein when one spring is applied, the two brake pads are connected to the spring via a fork-shaped rocker.

4. The disc brake structure according to claim 2, wherein the springs are mounted through a spring adjustment device.

5. The disc brake structure according to claim 2, wherein the spring is a pull spring.

6. The disc brake structure according to claim 2, wherein the spring is a pressure spring.

7. The disc brake structure according to claim 1, wherein when one spring is applied, the two brake pads are connected to the spring via a fork-shaped rocker.

8. The disc brake structure according to claim 7, wherein the springs are mounted through a spring adjustment device.

9. The disc brake structure according to claim 7, wherein the spring is a pull spring.

10. The disc brake structure according to claim 7, wherein the spring is a pressure spring.

11. The disc brake structure according to claim 1, wherein the springs are mounted through a spring adjustment device.

12. The disc brake structure according to claim 11, wherein the spring is a pull spring.

13. The disc brake structure according to claim 11, wherein the spring is a pressure spring.

14. The disc brake structure according to claim 1, wherein the spring is a pull spring.

15. The disc brake structure according to claim 1, wherein the spring is a pressure spring.

* * * * *